US006963833B1

(12) United States Patent
Singhal

(10) Patent No.: US 6,963,833 B1
(45) Date of Patent: Nov. 8, 2005

(54) MODIFICATIONS IN THE MULTI-BAND EXCITATION (MBE) MODEL FOR GENERATING HIGH QUALITY SPEECH AT LOW BIT RATES

(75) Inventor: Manoj Kumar Singhal, Bangalore (IN)

(73) Assignee: Sasken Communication Technologies Limited, Bangalore (IN)

( * ) Notice: Subject to any disclaimer, the term of this patent is extended or adjusted under 35 U.S.C. 154(b) by 505 days.

(21) Appl. No.: 09/697,276

(22) Filed: Oct. 26, 2000

Related U.S. Application Data

(60) Provisional application No. 60/161,681, filed on Oct. 26, 1999.

(51) Int. Cl.[7] ..... G10L 11/04

(52) U.S. Cl. ..... 704/207; 704/209

(58) Field of Search ..... 704/207, 209, 704/210

(56) References Cited

U.S. PATENT DOCUMENTS

| | | | | | |
|---|---|---|---|---|---|
| 5,890,108 | A | * | 3/1999 | Yeldener | 704/208 |
| 6,370,500 | B1 | * | 4/2002 | Huang et al. | 704/208 |
| 6,418,405 | B1 | * | 7/2002 | Satyamurti et al. | 704/206 |
| 6,453,287 | B1 | * | 9/2002 | Unno et al. | 704/219 |
| 6,470,309 | B1 | * | 10/2002 | McCree | 704/207 |

OTHER PUBLICATIONS

P. Bhattacharya, et al., *An Analysis of the Weaknesses of the MBE Coding Scheme,* Institute of Electrical & Electronics Engineers, Inc. (IEEE), International Conference on Personal Wireless Communications, Jan. 1999; p. 419–422.

Engin Erzin, et al., *Natural Quality Variable–Rate Spectral Speech Coding Below 3.0 KBPS,* Lucent Technologies & Dept. of Electrical & Computer Eng. at Univ. of Cal.

Michele Jamrozik, et al., *Modified Multiband Excitation Model at 2400 BPS,* Electrical & Computer Engineering at Clemson University.

Daniel W. Griffin, et al., *Multiband Excitation Vocoder,* IEEE Transactions on Acoustics, Speech, and Signal Processing, vol. 36, No. 8, Aug. 1988; p. 1223–1235.

Daniel W. Griffin, et al., *Signal Estimation from Modified Short–Time Fourier Transform,* IEEE Transactions on Acoustics, Speech, and Signal Processing, vol. ASSP–32, No. 2, Aug., 1984; p. 236–243.

John C. Hardwick, et al., *The Application of the IMBE Speech Coder to Mobile Communications,* IEEE, Jul. 1991; p. 249–252.

John Makhoul, *Linear Prediction: A Tutorial Review,* Reprinted from Proc. IEEE, vol. 63, No. 4, p. 561–580, Apr., 1975.

Robert J. McAulay, et al., *Computational Efficient Sine–Wave Sythesis and Its Application to Sinusoidal Transform Coding,* IEEE, Sep., 1988; p. 370–373.

Michael R. Portnoff, *Short–Time Fourier Analysis of Sampled Speech,* IEEE Transactions on Acoustics, Speech, and Signal Processing, vol. ASSP–29, No. 3, Jun., 1981; p. 364–373.

* cited by examiner

*Primary Examiner*—David L. Ometz
*Assistant Examiner*—Michael N Opsasnick
(74) *Attorney, Agent, or Firm*—Welsh & Katz, Ltd.

(57) ABSTRACT

The invention relates to improving parameter estimation and speech synthesis. Pursuant to one aspect of the invention, a path of pitch candidates having low errors is tracked to determine a pitch estimate. Pursuant to another aspect of the invention, a number of parameters are used to classify speech segments. Pursuant to another aspect of the invention, a voicing parameter is determined using a threshold value and bands are marked voiced or unvoiced depending on two error functions that compare synthesized voiced and unvoiced spectra to an original speech spectrum. Pursuant to another aspect of the invention a voicing parameter is used to facilitate lower bits for transmitting voicing decisions. Last, pursuant to other aspects of the invention, unvoiced speech is synthesized by incorporating a random generator, and harmonics phases are initialized with a fixed set of values.

26 Claims, 4 Drawing Sheets

MODIFICATIONS IN THE MULTI-BAND EXCITATION (MBE) MODEL FOR GENERATING HIGH QUALITY SPEECH AT LOW BIT RATES

CROSS REFERENCE TO RELATED APPLICATION

This application claims the benefit of U.S. Provisional Application No. 60/161,681, filed Oct. 26, 1999.

FIELD OF THE INVENTION

The invention relates to processing a speech signal. In particular, the invention relates to speech compression and speech coding.

BACKGROUND OF THE INVENTION

Compressing speech to low bit rates while maintaining high quality is an important problem, the solution to which has many applications, such as, for example, memory constrained systems. One compression scheme (coders) used to solve this problem is multi-band excitation (MBE), a scheme derived from sinusoidal coding.

The MBE scheme involves use of a parametric model, which segments speech into frames. Then, for each segment of speech, excitation and system parameters are estimated. The excitation parameters include pitch frequency values, voiced/unvoiced decisions and the amount of voicing in case of voiced frames. The system parameters include spectral magnitude and spectral amplitude values, which are encoded based on whether the excitation is sinusoidal or harmonic.

Though coders based on this model have been successful in synthesizing intelligible speech at low bit rates, they have not been successful in synthesizing high quality speech, mainly because of incorrect parameter estimation. As a result, these coders have not been widely used. Some of the problems encountered are listed as follows.

In the MBE model, parameters have a strong dependence on pitch frequency because all other parameters are estimated assuming that the pitch frequency has been accurately computed.

Most sinusoidal coders, including the MBE based coders, depend on an accurate reproduction of the harmonic structure of spectra for voiced speech segments. Consequently, estimating the pitch frequency becomes important because harmonics are multiples of the pitch frequency.

Another important aspect of the MBE scheme is the classification of a segment as voiced, unvoiced or silence segment. This is important because the three types of segments are represented differently and their representations have a different impact on the overall compression efficiency of the scheme. Previous schemes use inaccurate measures, such as zero-crossing rate and auto-correlation for these decisions.

MBE based coders also suffer from undesirable perceptual effects arising out of saturation caused by unbalanced output waveforms. An absence of phase information in decoders in use causes the unbalance.

Publications relevant to voice encoding include: McAulay et al., "Mid-Rate Coding based on a sinusoidal representation of speech", Proc. ICASSP85, pp. 945–948, Tampa, Fla., Mar. 26–29, 1985 (discusses the sinusoidal transform speech coder); Griffin, "Multi-band Excitation Vocoder", Ph.D. Thesis, M.I.T, 1987, (Discusses the Multi-Band Excitation (MBE) speech model and an 8000 kbps MBE speech coder); SM. Thesis, M.I.T, May 1988, (discusses a 4800 bps Multi-Band Excitation speech coder); McAulay et al., "Computationally efficient Sine-Wave Synthesis and its applications to Sinusoidal Transform coding", Proc. ICASSP 88, New York, N.Y., pp. 370–373, April 1988, (discusses frequency domain voiced synthesis); D. W. Griffin, J. S. Lim, "Multi-band Excitation Vocoder," IEEE Trans. Acoust., Speech, Signal Processing, vol. 36, pp. 1223–1235, August 1988; Tian Wang, Kun Tang, Chonxgi Feng "A high quality MBE-LPC-FE Speech coder at 2.4 kbps and 1.2 kbps, Dept. of Electronic Engineering, Tsinghua University, Beijing, 100084, P. R. Chinna; Engin Erzin, Arun kumar and Allen Gersho "Natural quality variable-rate spectral speech coding below 3.0 kbps, Dept. of Electrical & Computer Eng., University of California, Santa Barbara, Calif., 93106 USA; INMARSAT M voice codec, Digital voice systems Inc. 1991, version 3.0 August 1991; A. M. Kondoz, Digital speech coding for low bit rate communication systems, John Wiley and Sons; Telecommunications Industry Association (TIA) "APCO project 25 Vocoder description" Version 1.3, Jul. 15, 1993, IS102BABA (discusses 7.2 kbps IMBE speech coder for APCO project 25 standard); U.S. Pat. No. 5,081,681 (discloses MBE random phase synthesis); Jayant et al., Digital Coding of Waveforms, Prentice-Hall, 1984, (discussing the speech coding in general); U.S. Pat. No. 4,885,790 (discloses sinusoidal processing method); Makhoul, "A mixed-source model for speech compression and synthesis", IEEE (1978), pp. 163–166 ICASSP78; Griffin et al. "Signal estimation from modified short-time fourier transform", IEEE transactions on Acoustics, speech and signal processing, vol. ASSP-32, No. 2 , April 1984, pp 236–243; Hardwick, "A 4.8 kbps multi-band excitation speech coder", S.M. Thesis, M.I.T., May 1988; P. Bhattacharya, M. Singhal and Sangeetha, "An analysis of the weaknesses of the MBE coding scheme," IEEE international conf. on personal wireless communications, 1999; Almeida et al., "Harmonic coding: A low bit rate, good quality speech coding technique," IEEE (CH 1746-7/82/000 1684) pp. 1664–1667 (1982); Digital voice systems, Inc. "The DVSI IMBE speech compression system," advertising brochure (May 12, 1993); Hardwick et al., "The application of the IMBE speech coder to Mobile communications," IEEE (1991), pp. 249–252 ICASSP 91 May 1991; Portnoff, "Short-time fourier analysis of samples speech", IEEE transactions on acoustics, speech and signal processing , vol. ASSP-29, No-3, June 1981, pp. 324–333; W. B Klein and K. K. Paliwal "Speech coding and synthesis"; Akaike H., "Power spectrum estimation through auto-regressive model fitting," Ann. Inst. Statist. Math., Vol. 21, pp. 407–419, 1969; Anderson, T. W., "The statistical analysis of time series," Wiley, 1971; Durbin, J., "The fitting of time-series models," Rev. Inst. Int. Statist., Vol. 28, pp. 233–243, 1960; Makhoul J., "Linear Prediction: a tutorial review," Proc. IEEE, Vol. 63, pp. 561–580, April 1975; Kay S. M., "Modern spectral estimation: theory and application," Prentice Hall, 1988; Mohanty M., "Random signals estimation and identification," Van Nostrand Reinhold, 1986. The contents of these references are incorporated herein by reference.

Various methods have been described for pitch tracking but each method has its respective limitations. In "Processing a speech signal with estimated pitch" (U.S. Pat. No. 5,226,108), Hardwick, et al. has described a sub-multiple check method for pitch, a pitch tracking algorithm for estimating a correct pitch frequency and a voiced/unvoiced decision of each band, which is based on an energy threshold value.

In "Voiced/unvoiced estimation of an acoustic signal" (U.S. Pat. No. 5,216,747), Hardwick et al. has described a method for estimating voiced/unvoiced classifications for each band. The estimation, however, is based on a threshold value, which depends upon the pitch and the center frequency of each band. Similarly, in INMARSAT M voice codec (Digital voice systems Inc. 1991, version 3.0 August 1991) the voiced/unvoiced decision for each band depends upon threshold values which in turn depend upon the energy of current and previous frames. Occasionally, these parameters are not updated well, which results in incorrect decisions for some bands and a deteriorated output speech quality.

In "Synthesis of MBE based coded speech using regenerated phase information" (U.S. Pat. No. 5,701,390), Griffin et al. has described a method for generating a voiced component phase in speech synthesis. The phase is estimated from a spectral envelope of the voiced component (e.g. from the shape of the spectral envelope in the vicinity of the voiced component). The decoder reconstructs the spectral envelope and voicing information for each of a plurality of frames. The voicing information is used to determine whether frequency bands for a particular spectrum are voiced or unvoiced. Speech components for voiced frequency bands are synthesized using the regenerated spectral phase information. Components for unvoiced frequency bands are generated using other techniques.

The discussed methods do not provide solutions to the problems described above. The invention presents solutions to these problems and provides significant improvements to the quality of MBE based speech compression algorithms. For example, the invention presents a novel method for reducing the complexity of unvoiced synthesis at the decoder. It also describes a scheme for making the voiced/unvoiced decision for each band and computing a single Voicing Parameter, which is used to identify a transition point from a voiced to an unvoiced region in the spectrum; Compact spectral amplitude representation is also described.

BRIEF SUMMARY OF THE INVENTION

The invention includes methods to improve the estimation of parameters associated with the MBE model, methods that reduce the complexity of certain modules, and methods that facilitate the compact representation of parameters.

For example, one aspect of the invention relates to an improved pitch-tracking method to estimate pitch with greater accuracy. Pursuant to a first method that incorporates principles of the invention, five potential pitch candidates from each of a past, a current and a future frame are considered and a best path is traced to determine a correct pitch for the current frame. Moreover, pursuant to the first method, an improved sub-multiple checks algorithm, which checks for multiples of pitch and eliminates the multiples based on heuristics may be used.

Another aspect of the invention features a novel method for classifying active speech. This method, which is based on a number of parameters, determines whether a current frame is silence, voiced or unvoiced. The frame information is collected at different points in an encoder, and a final silence-voiced-unvoiced decision is made based on the cumulative information collected.

Another aspect of the invention features a method for estimating voiced/unvoiced decisions for each band of a spectrum and for determining a voice parameter (VP) value. Pursuant to a second method that incorporates principles of the invention, the voicing parameter is determined by finding an appropriate transition threshold, which indicates the amount of voicing present in a frame. Pursuant to the second method, the voiced/unvoiced decision is made for each band of harmonics with a single band comprising three harmonics. For each band a spectrum is synthesized twice: first assuming all the harmonics are voiced, and again assuming all the harmonics are unvoiced. An error for each synthesized spectra is obtained by comparing the respective synthesized spectrum with the original spectrum over each band. If the voiced error is less than the unvoiced error, the band is marked voiced, otherwise it is marked unvoiced.

Another aspect of the invention features an improved unvoiced synthesis method that reduces the amount of computation required to perform unvoiced synthesis, without compromising quality. Instead of generating a time domain random sequence and then performing an FFT to generate random phases for unvoiced spectral amplitudes like earlier described methods, a third method that incorporates principles of the invention directly uses a random generator to generate random phases for the estimated unvoiced spectral amplitudes.

Another aspect of the invention features a method to balance an output speech waveform and smoothen undesired perceptual artifacts. Generally, if phase information is not sent to a decoder, the generated output waveform is unbalanced and will lead to noticeable distortions when the input level is high, due to saturation. Pursuant to a fourth method that incorporates principles of the invention, harmonic phases are initialized with a fixed set of values during transitions from unvoiced frames to voiced frames. These phases may be updated over successive voiced frames to maintain continuity.

In another aspect of the invention, a linear prediction technique is used to model spectral amplitudes. A spectral envelope contains magnitudes of all harmonics in the frame. Encoding these amplitudes requires a large number of bits. Because the number of harmonics depends on the fundamental frequency, the number of spectral amplitudes varies from frame to frame. It is more practical, therefore, to quantize the general shape of the spectrum, which can be assumed to be independent of the fundamental frequency. As a result, these spectral amplitudes are modeled using a linear prediction technique, which helps reduce the number of bits required for representing the spectral amplitudes. The LP coefficients are mapped to corresponding Line Spectral Pairs (LSP) which are then quantized using multi-stage vector quantization, each stage quantizing the residual of the previous one.

In another aspect of the invention, a voicing parameter (VP) is used to reduce the number of bits required to transmit voicing decisions of all bands. The VP denotes a band threshold, under which all bands are declared unvoiced and above which all bands are marked voiced. Instead of a set of decisions, a single VP is now transmitted.

In another aspect of the invention, a fixed pitch frequency is assumed for all unvoiced frames and all the harmonic magnitudes are computed by taking the root mean square value of the frequency spectrum over desired regions.

BRIEF DESCRIPTION OF THE DRAWINGS

Further objects of the invention, taken together with additional features contributing thereto and advantages occurring therefrom, will be apparent from the following description of the invention when read in conjunction with the accompanying drawings, wherein.

DETAILED DESCRIPTION OF THE INVENTION

Figure 1:
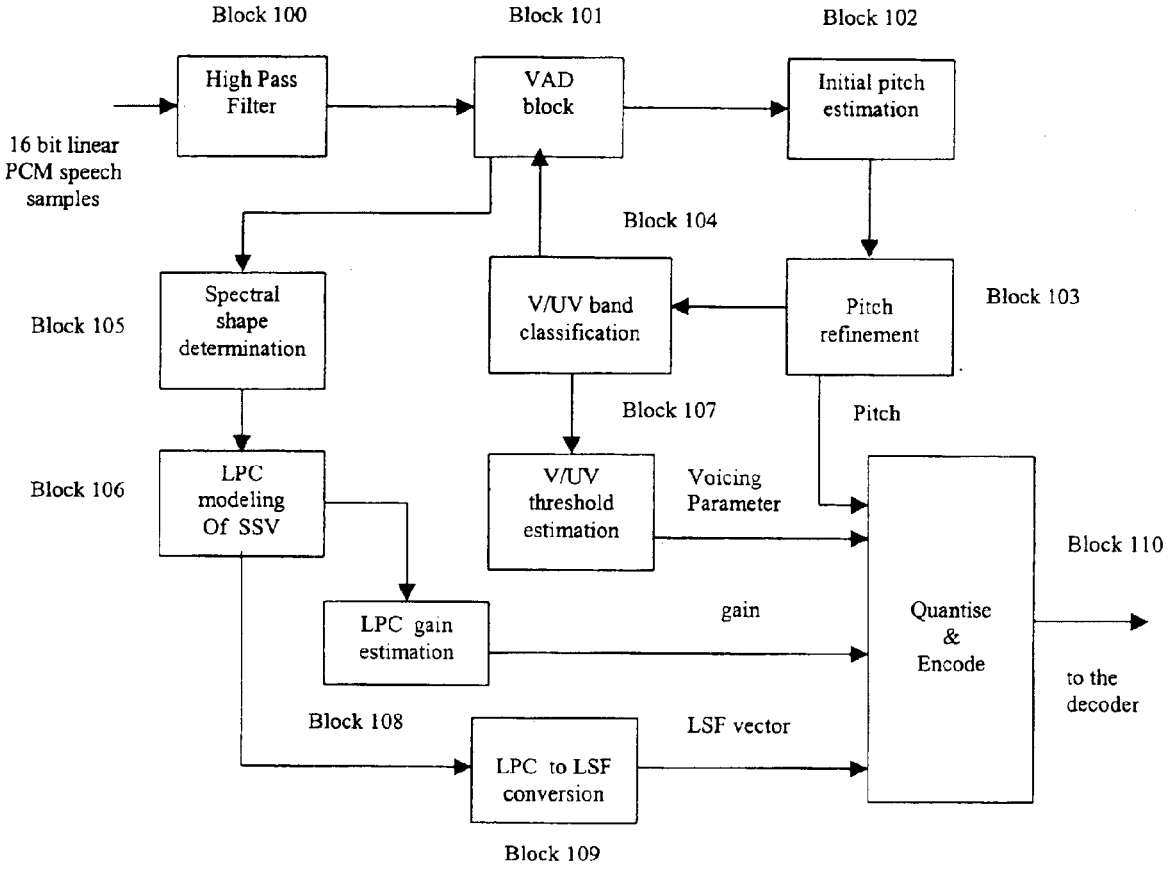
FIG. 1 is a block diagram of an MBE encoder that incorporates principles of the invention.

While the invention is susceptible to use in various embodiments and methods, there is shown in the drawings and will hereinafter be described specific embodiments and methods with the understanding that the disclosure is to be considered an exemplification of the invention and is not intended to limit the invention to the specific embodiments and methods illustrated.

This invention relates to a low bit rate speech coder designed as a variable bit rate coder based on the Multi Band Excitation (MBE) technique of speech coding.

A block diagram of an encoder that incorporates aspects of the invention is depicted in FIG. 1. The depicted encoder performs various functions including, for example, analysis of an input speech signal, parameterization and quantization of parameters.

In the analysis stage of the encoder, the input speech is passed through block 100 to high-pass filter the signal to improve pitch detection, for situations where samples are received through a telephone channel. The output of block 100 is passed to a voice activity detection module, block 101. This block performs a first level active speech classification, classifying frames as voiced and voiceless. The frames classified voiced by block 101 are sent to block 102 for coarse pitch estimation. The voiceless frames are passed directly to block 105 for spectral amplitude estimation.

During coarse pitch estimation (block 102), a synthetic speech spectrum is generated for each pitch period at half sample accuracy, and the synthetic spectrum is then compared with the original spectrum. Based on the closeness of the match, an appropriate pitch period is selected. The coarse pitch is obtained and further refined to quarter sample accuracy in block 103 by following a procedure similar to the one used in coarse pitch estimation. However, during quarter sample refinement, the deviation is measured only for higher frequencies and only for pitch candidates around the coarse pitch.

Based on the pitch estimated in block 103, the current spectrum is divided into bands and a voiced/unvoiced decision is made for each band of harmonics in block 104 (a single band comprises three harmonics). For each band, a spectrum is synthesized, first assuming all the harmonics in the band are voiced, and then assuming all the harmonics in the band are unvoiced. An error for each synthesized spectra is obtained by comparing the respective synthesized spectrum with the original spectrum over each band. If the voiced error is less than the unvoiced error, the band is marked voiced, otherwise it is marked unvoiced.

In order to reduce the number of bits required to transmit the voicing decisions found in block 104, a Voicing Parameter (VP) is introduced. The VP denotes the band threshold, under which all bands are declared unvoiced and above which all bands are marked voiced. Instead of a set of decisions, a single VP is calculated in block 107.

Speech spectral amplitudes are estimated by generating a synthetic speech spectrum and comparing it with the original spectrum over a frame. The synthetic speech spectrum of a frame is generated so that distortion between the synthetic spectrum and the original spectrum is minimized in a sub-optimal manner in block 105.

Spectral magnitudes are computed differently for voiced and unvoiced harmonics. Unvoiced harmonics are represented by the root mean square value of speech in each unvoiced harmonic frequency region. Voiced harmonics, on the other hand, are represented by synthetic harmonic amplitudes, which accurately characterize the original spectral envelope for voiced speech.

The spectral envelope contains magnitudes of each harmonic present in the frame. Encoding these amplitudes requires a large number of bits. Because the number of harmonics depends on the fundamental frequency, the number of spectral amplitudes varies from frame to frame. Consequently, the spectrum is quantized assuming it is independent of the fundamental frequency, and modeled using a linear prediction technique in blocks 106 and 108. This helps reduce the number of bits required to represent the spectral amplitudes. LP coefficients are then mapped to corresponding Line Spectral Pairs (LSP) in block 109, which are then quantized using multi-stage vector quantization. The residual of each quantizing stage is quantized in a subsequent stage in block 110.

Figure 2:
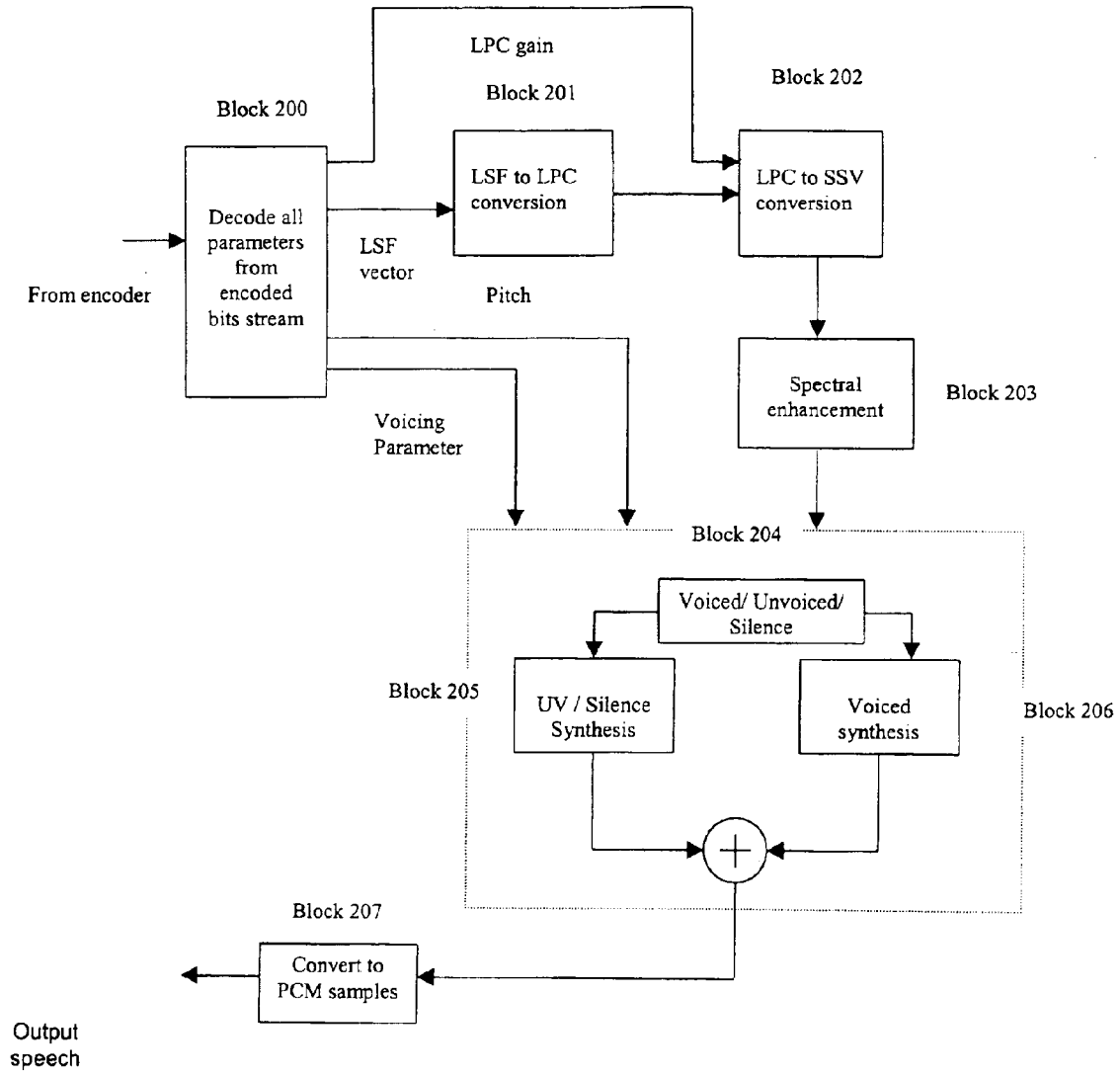
FIG. 2 is a block diagram of an MBE decoder that incorporates principles of the invention.

The block diagram of a decoder that incorporates aspects of the invention is illustrated in FIG. 2. Parameters from the encoder are first decoded in block 200. A synthetic speech spectrum is then reconstructed using decoded parameters, including a fundamental frequency value, spectral envelope information and voiced/unvoiced characteristics of the harmonics. Speech synthesis is performed differently for voiced and unvoiced components and consequently depends on the voiced/unvoiced decision of each band. Voiced portions are synthesized in the time domain whereas unvoiced portions are synthesized in the frequency domain.

The spectral shape vector (SSV) is determined by performing a LSF to LPC conversion in block 201. Then using the LPC gain and LPC values computed during the LSF to LPC conversion (block 201), a SSV is computed in block 202. The SSV is spectrally enhanced in block 203 and inputted into block 204. The pitch and VP from the decoded stream are also inputted into block 204. In block 204, based on the voiced/unvoiced decision, a voiced or unvoiced synthesis is carried out in blocks 206 or 205, respectively.

An unvoiced component of speech is generated from harmonics that are declared unvoiced. Spectral magnitudes of these harmonics are each allotted a random phase generated by a random phase generator to form a modified noise spectrum. The inverse transform of the modified spectrum corresponds to an unvoiced part of the speech.

Voiced speech represented by individual harmonics in the frequency domain is synthesized using sinusoidal waves. The sinusoidal waves are defined by their amplitude, frequency and phase, which were assigned to each harmonic in the voiced region.

The phase information of the harmonics is not conveyed to the decoder. Therefore, in the decoder, at transitions from an unvoiced to a voiced frame, a fixed set of initial phases having a set pattern is used. Continuity of the phases is then maintained over the frames. In order to prevent discontinuities at edges of the frame due to variations in the parameters of adjacent frames, both the current and previous frame's parameters are considered. This ensures smooth transitions at boundaries. The two components are then finally combined to produce a complete speech signal by conversion into PCM samples in block 207.

Most sinusoidal coders, including the MBE vocoder, crucially depend on accurately reproducing the harmonic structure of spectra for voiced speech segments. Since harmonics are merely multiples of the pitch frequency, the pitch parameter assumes a central role in the MBE scheme. As a result, other parameters in the MBE coder are dependent on the accurate estimation of the pitch period.

Although there have been many pitch estimation algorithms, each one has its own limitation. Deviations between the pitch estimates of consecutive frames are bound to occur and these errors produce artifacts, which are essentially perceived. Therefore, in order to improve the pitch estimate by preventing abrupt changes in the pitch trajectory, a good tracking algorithm that ensures consistent pitch estimates of consecutive frames is required. Further, in order to remove the pitch doubling and tripling errors, a sub-multiple check algorithm, which supplements the pitch tracking algorithm, is required. Thus, ensuring correct pitch estimation in a frame.

In the MBE scheme of the INMARSAT M voice codec (Digital voice systems Inc. 1991, version 3.0 August 1991), the pitch tracking module used attempts to improve a pitch estimate by limiting the pitch deviation between consecutive frames, as follows:

In the INMARSAT M voice codec, an error function, E(P), which is a measure of spectral error between the original and synthesized spectrum and which assumes harmonic structure at intervals corresponding to a pitch period (P) is calculated. If the criterion for selecting pitch were based strictly on error minimization of a current frame, the pitch estimate may change abruptly between succeeding frames, causing audible degradation in synthesized speech. Hence, two previous and two fixture frames are considered while tracking in the INMARSAT M voice codec.

For each speech frame, two different pitch estimates are computed: (1) the backward pitch estimate calculated using look-back tracking, and (2) the forward pitch estimate calculated using look-ahead tracking.

The look-back tracking algorithm of the INMARSAT M voice codec uses information from two previous frames. $P_{-2}$ and $P_{-1}$ denote initial pitch estimates calculated during analysis of the two previous frames, respectively, and $E_{-2}(P_{-2})$ and $E_{-1}(P_{-1})$ denote their corresponding error functions.

In order to find $P_0$, an error function $E(P_0)$ is evaluated for each pitch candidate falling in the range:

$$0.8P_{-1}<=P0<=1.2P_{-1}. \tag{1}$$

The $P_0$ value corresponding to the minimum error ($E(P_0)$) is selected as the backward pitch estimate ($P_B$), and the cumulative backward error ($CE_B$) is calculated using the equation:

$$CE_B(P_B)=E(P_B)+E_{-1}(P_{-1})+E_{-2}(P_{-2}). \tag{2}$$

Look-ahead tracking attempts to preserve continuity between future speech frames. Since pitch has not been determined for the two future frames being considered, the look-ahead pitch tracking of the INMARSAT M voice codec selects pitch for these frames, $P_1$ and $P_2$, after assuming a value for $P_0$. Pitch is selected for $P_1$ so that $P_1$ belongs to {21, 21.5 . . . 114}, and pursuant to the relationship:

$$0.8P_0<=P_1<=1.2P_0 \tag{3}$$

Pitch is selected for $P_2$ so that $P_2$ belongs to {21,21.5 . . . 114}, and pursuant to the relationship:

$$0.8P_1<=P_2<=1.2P_1 \tag{4}$$

$P_1$ and $P_2$ are selected so their combined errors $[E_1(P_1)+E_2(P_2)]$ are minimized.

The cumulative forward error is then calculated pursuant to the equation:

$$CE_F(P_0)=E(P_0)+E_1)(P_1)+E_2(P_2). \tag{5}$$

The process is repeated for each $P_0$ in the set (21, 21.5, . . . 114), and the $P_0$ value corresponding to a minimum cumulative forward error $CE_F(P_0)$ is selected as the forward pitch estimate.

Once $P_0$ is determined, the integer sub-multiples of $P_0$ (i.e. $P_0/2$, $P_0/3$, . . . $P_0/n$) are considered. Every sub-multiple, which is greater than or equal to 21 is computed and replaced with the closest half sample. The smallest of these sub-multiples is applied to constraint equations. If the sub-multiple satisfies the constraint equations, then that value is selected as the forward pitch estimate $P_F$. This process continues until all the sub-multiples, in ascending order, have been tested against the constraint equations. If no sub-multiple satisfies these constraints,
then $P_F=P_0$.

The forward pitch estimate is then used to compute the forward cumulative error as follows:

$$CE_F(P_F)=E(P_F)+E_1(P_1)+E_2(P_2) \tag{6}$$

Next, the forward cumulative error is compared against the backward cumulative error using a set of heuristics. This comparison determines whether the forward pitch estimate or the backward pitch estimate is selected as the initial pitch estimate for the current frame.

The discussed algorithm of the INMARSAT M voice codec requires information from two previous frames and two future frames to determine the pitch estimate of a current frame. This means that in order to estimate the pitch of a current frame, a two future frame wait is required. This increases algorithmic delay in the encoder. The algorithm of the INMARSAT M voice codes is also computationally expensive.

An illustrative pitch tracking method, pursuant to an aspect of the invention, that circumvents these problems and improves performance is described below.

Pursuant to the invention, the illustrative pitch tracking method is based on the closeness of a spectral match between the original and the synthesized spectrum for different pitch periods, and thus exploits the fact that the correct pitch period corresponds to a minimal spectral error.

In the illustrative pitch tracking method, five pitch values of the current frame which have the least errors (E(P)) associated with them are considered for tracking since the pitch of the current frame will most likely be one of the values in this set. Five pitch values of a previous frame, which have the least errors associated with them, and five pitch values of a future frame, which have the least error (E(P)) associated with them, are also selected for tracking.

All possible paths are then traced through a trellis that includes the five pitch values corresponding to five E(P) minima of the previous frame in a first stage, five pitch values corresponding to five E(P) minima of the current frame in a second stage, and five pitch values corresponding to five E(P) minima of the fixture frame in a third stage. A cumulative error function, called the Cost Function (CF), is evaluated for each path:

$$CF=k^*(E_{-1}+E_{-k})+\log(P_{-1}/P_{-k})+k^*(E_{-k}+E_{-j})+\log(P_{-k}/P_{-j}). \tag{7}$$

CF is the total error defined over a trajectory. $P_{-1}$, is a selected pitch value for the previous frame, $P_{-k}$ is a selected pitch value for the current frame, and $P_{-j}$ is a selected pitch value for a future frame, $E_{-1}$ is an error value for $P_{-1}$, $E_{-k}$ is an error value for $P_{-k}$, $E_{-j}$ is an error value for $P_{-j}$, and k is a penalizing factor that has been tuned for optimal performance. The path having the minimum CF value is selected.

Depending on the type of previous and future frames, different cases arise, each of which are treated differently. If the previous frame is unvoiced or silence, then the previous frame is ignored and paths are traced between pitch values of the current frame and the future frame. Similarly, if the future frame is not voiced, then only the previous frame and current frame are taken into consideration for tracking.

By using pitch values lying in the path of minimum error, backward and forward pitch estimates can be computed with which the initial pitch estimate of the current frame can be evaluated, as explained below.

For the illustrative pitch tracking method, let $P_0$ denote the pitch of the current frame lying in the least error path and $E(P_0)$ denote the associated error function.

Once $P_0$ is determined, the integer sub-multiples of $P_0$ (i.e. $P_0/2$, $P_0/3$, . . . $P_0/n$) are considered. Every sub-multiple, which is greater than or equal to 21 is computed and replaced with the closest half sample. The smallest of these sub-multiples is checked with backward constraint equations. If the sub-multiple satisfies the backward constraint equations, then that value is selected as the backward pitch estimate $P_B$. This process continues until all the sub-multiples, in ascending order, have been tested by the backward constraint equations. If no sub-multiple satisfies the backward constraint equations, then $P_0$ is selected as the backward pitch estimate ($P_B=P_0$).

The backward pitch estimate is then used to compute the backward cumulative error by applying the equation:

$$CE_B(P_B)=E(P_B)+E_{-1}(P_{-1}). \tag{8}$$

To calculate the forward pitch estimate, according to the illustrative pitch tracking method, a sub-multiple check is performed and checked with forward constraint equations. Examples of acceptable forward constraint equations are listed below.

$$CE_F(P_0/n)\leqq 0.85 \text{ and } CE_F(P_0/n)/CE_F(P_0)\leqq 1.7 \tag{9}$$

$$CE_F(P_0/n)\leqq 0.4 \text{ and } CE_F(P_0/n)/CE_F(P_0)\leqq 3.5 \tag{10}$$

$$CE_F(P_0/n)\leqq 0.5 \tag{11}$$

The smallest sub-multiple which satisfies the forward constraint equations is selected as the forward pitch estimate $P_F$. If a sub-multiple does not satisfy the forward constraint equations, $P_0$ is selected as the forward pitch estimate ($P_F=P_0$).

The forward pitch estimate is then used to calculate the forward cumulative error by applying the equation:

$$CE_F(P_F)=E(P_F)+E_{-1}(P_{-1}) \tag{12}$$

Pursuant to the illustrated pitch tracking method, the forward and backward cumulative errors are then compared with one another based on a set of decision rules, depending on which estimate is selected as the initial pitch candidate for the current frame.

The illustrated pitch tracking method, which incorporates principles of the invention, addresses a number of shortcomings prevalent in tracking algorithms in use. First, the illustrated method uses a single frame look-ahead compared to a two frame look-ahead, and thus reduces algorithmic delay. Moreover, it can use a sub-multiple check for backward pitch estimation, thus increasing pitch estimate accuracy. Further, it reduces computational complexity by using only five pitch values per selected frame.

A speech signal comprises of silence, voiced segments and unvoiced segments. Each speech signal category requires different types of information for accurate reproduction during the synthesis phase. Voice segments require information regarding fundamental frequency, degree of voicing in the segment and spectral amplitudes. Unvoiced segments, on the other hand, require information regarding spectral amplitudes for natural reproduction. This applies to silence segments as well.

A speech classifier module is used to provide a variable bit rate coder, and, in general, to reduce the overall bit rate of the coder. The speech classifier module reduces the overall bit rate by reducing the number of bits used to encode unvoiced and silence frames compared to voiced frames.

Coders in use have employed voice activity detection (VAD) and active speech classification (ASC) modules separately. These modules are based on characteristics such as zero crossing rate, autocorrelation coefficients and so on.

A descriptive speech classifier method, which incorporates principles of the invention, is described below. The described speech classifier method uses several characteristics of a speech frame before making a speech classification. Thus the classification of the descriptive method is accurate.

The described speech classifier method performs speech classification in three steps. In the first step, an energy level is used to classify frames as voiced or voiceless at a gross level. The base noise energy level of the frames is tracked and the minimum noise level encountered corresponds to a background noise level.

Pursuant to the descriptive speech classifier method, energy in the 60–1000 Hz band is determined and used to calculate the ratio of the determined energy to the base noise energy level. The ratio can be compared with a threshold derived from heuristics, which threshold is obtained after testing over a set of 15000 frames having different background noise energy levels. If the ratio is less than the threshold, the frame is marked unvoiced, otherwise it is marked voiced.

The threshold is biased towards voiced frames, and thus ensures voiced frames are not marked unvoiced. As a result, unvoiced frames may be marked voiced. In order to correct this, a second detailed step of classification is carried out which acts as an active speech classifier and marks frames as voiced or unvoiced. The frames marked voiced in the previous step are passed through this module for more accurate classification.

Pursuant to the descriptive speech classifier method, voiced and unvoiced bands are classified in the second classification step module. This module determines the amount of voicing present at a band level and a frame level by dividing a spectrum of a frame into several bands, where each band contains three harmonics. Band division is based on the pitch frequency of the frame. The original spectrum of each band is then compared with a synthesized spectrum that assumes harmonic structure. A voiced and unvoiced band decision is made on the comparison. If the match is close, the band is declared voiced, otherwise it is marked unvoiced. At the frame level, if all the bands are marked unvoiced, the frame is declared unvoiced, otherwise it is declared voiced.

To distinguish silence frames from unvoiced frames, in the descriptive speech classifier method, a third step of classification is employed where the frame's energy is computed and compared with an empirical threshold value. If the frame energy is less than the threshold, the frame is marked silence, otherwise it is marked unvoiced. The descriptive speech classifier method makes use of the three steps discussed above to accurately classify silence, unvoiced and voiced frames.

In summary, the descriptive speech classifier method uses multiple measures to improve Voice Activity Detection (VAD). In particular, it uses spectral error as a criterion for determining whether a frame is voiced or unvoiced. This is very accurate. The method also uses an existing voiced-unvoiced band decision module for this purpose, thus reducing computation. Further, it uses a band energy-tracking algorithm in the first phase, making the algorithm robust to background noise conditions.

In the multi-band excitation (MBE) model, a single voiced-unvoiced classification of a classical vocoder is replaced by a set of voiced-unvoiced decisions taken over harmonic intervals in the frequency domain. In order to obtain natural quality speech, it is imperative that these band voicing decisions are accurate. The band voicing classification algorithm involves dividing the spectrum of the frame into a number of bands, wherein each band contains three harmonics. The band division is performed based on the pitch frequency of the frame. The original spectrum of each band is then compared with a spectrum that assumes harmonic structure. Finally, the normalized squared error between the original and the synthesized spectrum over each band is computed and compared with the energy dependent threshold value and declared voiced if the error is less than the threshold value, otherwise it is declared voiced. The voicing parameter algorithm, which has been used in the INMARSAT M voice codec (Digital voice systems Inc. 1991, version 3.0 August 1991) relies on frame energy change, the updation of which is not up to standards, for its threshold.

In other algorithms, errors occurring in the voiced/unvoiced band classification can be characterized in two different ways: (a) coarse and fine, and (b) Voiced classification as unvoiced and vice versa.

The frame, as a whole, can be wrongly classified, in which case the error is characterized as a coarse error. Sudden surges or dips in the voicing parameter also come under this category. If the error is restricted to one or more bands of a frame then the error is characterized as a fine error. The coarse and fine errors are perceptually distinguishable.

A voicing error can also occur as a result of a voiced band marked unvoiced or an unvoiced band marked voiced. Either of these errors can be coarse or fine, and are audibly distinct.

A coarse error spans over an entire frame and results in each voiced band being marked unvoiced, the production of unwanted clicks, and if the error persists over a few frames, the introduction of one type of hoarseness into the decoded speech. Coarse errors that involve unvoiced bands of a frame being inaccurately classified as voiced cause phantom tone generation, which produces a ringy effect in the decoded speech. If this error occurs over two or more consecutive frames, the ringy effect becomes very pronounced, further deteriorating decoded speech quality.

On the other hand, fine errors that are biased towards unvoicing over a set of frames introduce a husky effect into the decoded speech while those biased towards voicing result in overvoicing, thus producing a tonal quality in the output speech.

An exemplary voicing parameter (VP) estimation method that incorporates principles of the invention is described below. The exemplary VP estimation method is independent of energy threshold values. Pursuant to the exemplary method, the complete spectrum is synthesized assuming each band is unvoiced, i.e. each point in the spectrum over a desired region is replaced by the root mean square (r.m.s) value of spectrum amplitude over that band. The same spectrum is also synthesized assuming each band is voiced, i.e. a harmonic structure is imposed over each band using a pitch frequency. But, when imposing the harmonic structure over each band, it is assured that a valley between two consecutive harmonics is not below an actual valley of corresponding harmonics in the original spectrum. This is achieved by clipping each synthesized valley amplitude to a minimum value of the original spectrum between the corresponding two consecutive harmonics.

Next, in the exemplary VP estimation method, the mean square error over each band for both spectrums is computed from the original spectrum. If the error between the original spectrum and the synthesized spectrum that assumes an unvoiced band is less than the error between the original spectrum and synthesized spectrum that assumes a voiced band (harmonic structure over that band), the band is declared unvoiced, otherwise it is declared voiced. The same process is repeated for the remaining bands to get the voiced-unvoiced decisions for each band.

Figure 3:
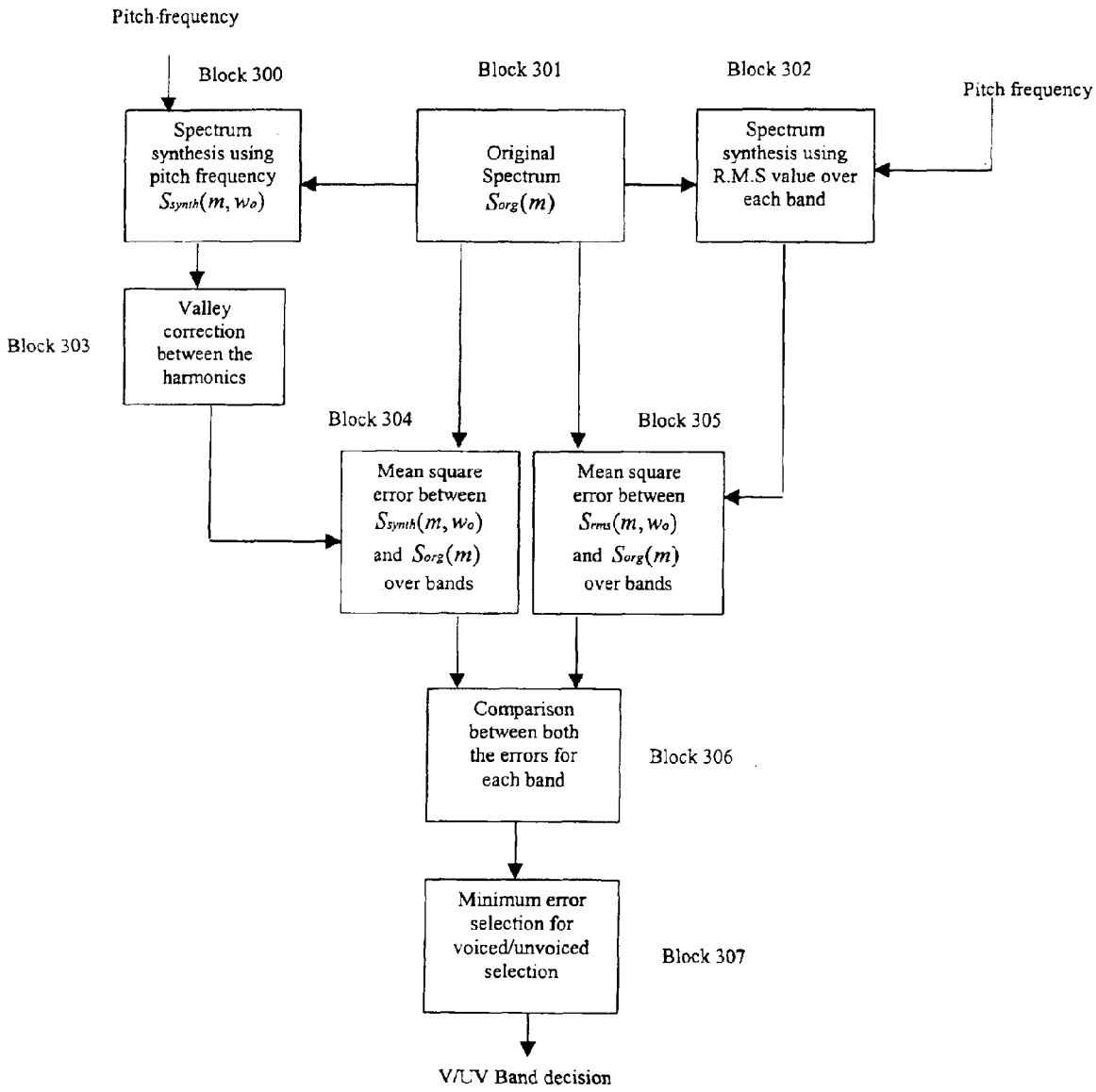
FIG. 3 is a block diagram that depicts an exemplary voicing parameter estimation method pursuant to an aspect of the invention.

FIG. 3 shows a block diagram of the exemplary VP estimation method. In block 300, the entire spectrum is synthesized for each harmonic assuming each harmonic is voiced. The spectrum is synthesized using pitch frequency and actual spectrum information for the frame. The complete harmonic structure is generated by using the pitch frequency and centrally placing the standard Hamming window of required resolution around actual harmonic amplitudes. Block 301 represents the complete spectrum (i.e. the fixed point FFT) of the original input speech signal.

In block 302, the entire spectrum is synthesized for each harmonic assuming each harmonic is unvoiced. The complete spectrum is synthesized using the root mean square (r.m.s) value for each band over that region in the actual spectrum. Thus, the complete spectrum is synthesized by replacing actual spectrum values in that region by the r.m.s value in that band. In block 303, valley compensation between two successive harmonics is used to ensure that the synthesized valley amplitude between corresponding successive harmonics is not less than the actual valley amplitude between corresponding harmonics. In block 304, the mean square error is computed over each band between the actual spectrum and the synthesized spectrum assuming each harmonic is voiced. In block 305, the mean square error is computed over each band between the actual spectrum and the synthesized spectrum assuming each harmonic is unvoiced (each band is replaced by its r.m.s. value over that region). In block 306, the unvoiced error for each band is compared with the voiced error for each band; The voiced-unvoiced decision is determined for each band by selecting the band decision having minimum error in block 307.

For the exemplary VP estimation method, let $S_{org}(m)$ be the original frequency spectrum of a frame, and let $S_{synth}(m, w_o)$ be the synthesized spectrum of the frame that assumes a harmonic structure over the entire spectrum and that uses a fundamental frequency, $w_o$. The fundamental frequency $w_o$ is used to compute the error from the original spectrum $S_{org}(m)$.

Let $S_{srms}(m)$ be the synthesized spectrum of the current frame that assumes an unvoiced frame. Spectrum points are replaced by the root mean square values of the original spectrum over that band (each band contains three harmonics except the last band, which contains the remaining number of the total harmonics).

Let $error_{uv}(k)$ be the mean squared error over the $k^{th}$ band between the frequency spectrum ($S_{org}(m)$) and the spectrum that assumes an unvoiced frame ($S_{srms}(m)$).

$$error_{uv}(k)=((S_{org}(m)-S_{rms}(m))*(S_{org}(m)-S_{rms}(m)))/N \quad (13)$$

N is the total number of points used over that region to compute the mean square error.

Similarly, let $error_{voiced}(k)$ be the mean squared error over the $k^{th}$ band between the frequency spectrum $S_{org}(m)$ and the spectrum that assumes a harmonic structure ($S_{synth}(m, w_o)$).

$$error_{voice}(k)=((S_{org}(m)-S_{synth}(m))*(S_{org}(m)-S_{synth}(m)))/N \quad (14)$$

Pursuant to the exemplary VP estimation method, the $k^{th}$ band is declared voiced if the $error_{voiced}(k)$ is less than the $error_{uv}(k)$ over that region, otherwise the band is declared unvoiced. Similarly, each band is checked to determine the voiced-unvoiced decisions for each band.

Pursuant to an illustrative Voicing Parameter (VP) threshold estimation method that incorporates principles of the invention, a VP is introduced to reduce the number of bits required to transmit voicing decisions for each band. The VP denotes a band threshold, under which all bands are declared unvoiced and above which all bands are marked voiced. Hence, instead of a set of decisions, a single VP can be transmitted. Experimental results have proved that if the threshold is determined correctly, there will be no perceivable deterioration in decoded speech quality.

The illustrative voicing parameter (VP) threshold estimation method uses a VP for which the hamming distance between the original and the synthesized band voicing bit strings is minimized. As a further extension, the number of voiced bands marked unvoiced and that of unvoiced bands marked voiced can be penalized differentially to conveniently provide a biasing towards either. Pursuant to the illustrative VP threshold estimation method, the final form of the weighted bit error for a band threshold at the $k^{th}$ band is given by:

$$\varepsilon(k) = c_v \sum_{i=1}^{k} (1 - a_i) + \sum_{j=k+1}^{m} a_j \quad (15)$$

$a_i$, i=1, . . . ,m are the original binary band decisions and $c_v$ is a constant that governs differential penalization. This removes sudden transitions from the voicing parameter.

In sum, degradation in decoded speech quality due to errors in VP estimation have been minimized using the illustrative VP threshold estimation method. Most problems inherent in previous voiced-unvoiced band classifications used in the INMARSAT M voice codec (Digital voice systems Inc. 1991, version 3.0 August 1991) have also been eliminated by replacing the previous module by the exemplary voicing parameter estimation method and the illustrative voicing parameter (VP) threshold estimation method, which also improves decoded speech quality.

In an MBE based decoder, voiced and unvoiced speech synthesis is done separately, and unvoiced synthesized speech and voiced synthesized speech is combined to produce complete synthesized speech. Voiced speech synthesis is done using standard sinusoidal coding, while unvoiced speech synthesis is done in the frequency domain. In the INMARSAT M voice codec (Digital voice systems Inc. 1991, version 3.0 August 1991), to generate unvoiced speech, a random noise sequence of specific length is initially generated and its Fourier transform is taken to generate a complete unvoiced spectrum. Then, the spectrum amplitudes of a random noise sequence are replaced by actual unvoiced spectral amplitudes, keeping phase values equal to those of the random noise sequence spectrum. The rest of the amplitude values are set to zero. As a result, the unvoiced spectral amplitudes remain unchanged but their phase values are replaced by the actual phases of the random noise sequence.

Later, the inverse Fourier transform of the modified unvoiced spectrum is taken to get the desired unvoiced speech. Finally, the weighted overlap method is applied to get the actual unvoiced samples using the current and previous unvoiced speech samples using a standard synthesis window of desired length.

The unvoiced speech synthesis algorithm used in the INMARSAT M voice codec is computationally complex and involves both Fourier and inverse Fourier transforms of the random noise sequence and modified unvoiced speech spectrum. A descriptive unvoiced speech synthesis method that incorporates principles of the invention is described below.

The descriptive unvoiced speech synthesis method only involves one Fourier transform, and consequently reduces the computational complexity of unvoiced synthesis by one-half with respect to the algorithm employed in the INMARSAT M voice codec (Digital voice systems Inc. 1991, version 3.0 August 1991).

Initially, pursuant to the descriptive unvoiced speech synthesis method, a random noise sequence of desired length is generated and, later, each generated random value is transformed to get random phases, which are uniformly distributed between negative π and π. Then, random phases are assigned to an actual unvoiced spectral amplitude to get a modified unvoiced speech spectrum. Finally, the inverse Fourier transform is taken for the unvoiced speech spectrum to get a desired unvoiced speech signal. However, since the length of the synthesis window is longer than the frame size, the unvoiced speech for each segment overlaps the previous frame. A weighted Overlap Add method is applied to average these sequences in the overlapping regions.

Let U(n) be the sequence of random numbers, which are generated using the equation:

$$U(n+1)=171*U(n)+11213-53125*\lfloor(171*U(n)+11213)/53125\rfloor \quad (16)$$

$\lfloor \sqrt[3]{} \rfloor$ represent the integer part of the fractional number, and U(0) is initially set to 3147. Alternatively, the randomness in the unvoiced spectrum may be provided by using a different random noise generator. This is within the scope of this invention.

Pursuant to the descriptive unvoiced speech synthesis method, each random noise sequence value is computed from equation 16 and, later, each random value is transformed between negative π and π. Let $S_{amp}(l)$ be the amplitude of the $l^{th}$ harmonic. The random phases are assigned to the actual spectral amplitudes, and the modified unvoiced spectrum over the $l^{th}$ harmonic region is given by:

$$U_w(m)=S_{amp}(l)*(\cos(\phi)+j\sin(\phi)) \quad (17)$$

φ is the random phase assigned to the $l^{th}$ 1harmonic.

Last, the inverse Fourier transform is taken for $U_w(m)$ to get the unvoiced signal in the time domain using the equation:

$$u(n) = 1/N \sum_{m=-N/2}^{m=N/2-1} U(m)\exp((j*2*\pi*m*n)/N) \quad (18)$$

$$\text{For } N/2 \le n < N/2-1$$

N is the number of FFT points used for inverse computation.

Figure 4:
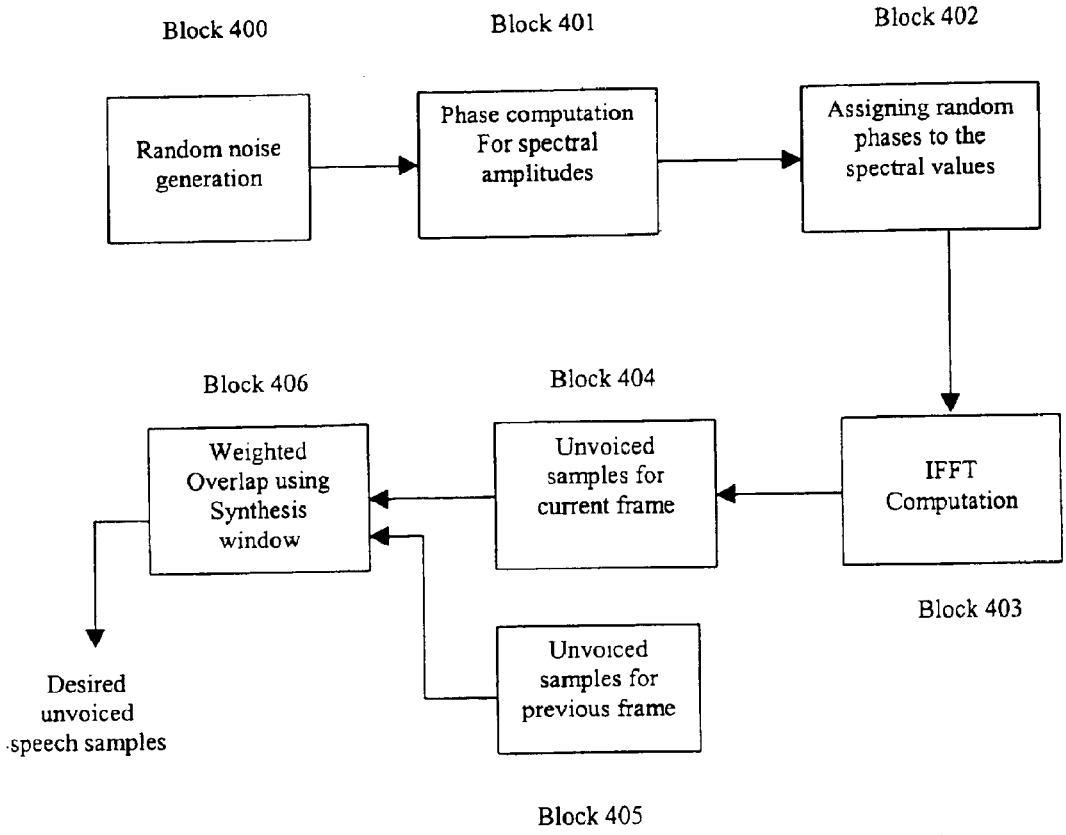
FIG. 4 is a block diagram that depicts a descriptive unvoiced speech synthesis method pursuant to an aspect of the invention.

Later, to get the actual unvoiced portion of the current frame, a weighted overlap method is used on the current and the previous frame unvoiced samples using a standard synthesis window. Blocks 401, 402 and 403 (FIG. 4) are used to generate random phase values, to assign these phase values to the spectral amplitudes and to take an inverse FFT to compute unvoiced speech samples for the current frame. The descriptive unvoiced speech synthesis method reduces the computational complexity by one-half (by reducing one FFT computation) with respect to the unvoiced speech synthesis algorithm used in INMARSAT M voice codec (Digital voice systems Inc. 1991, version 3.0 August 1991), without any degradation in output speech quality.

Phase information plays a fundamental role, especially in voiced and transition parts of speech segments. To maintain good quality speech, phase information must be based on a well-defined strategy or model.

In the INMARSAT M voice codec (Digital voice systems Inc. 1991, version 3.0 August 1991), phase initialization for each harmonic is performed in a specific manner in the decoder, i.e. initial phases for the first one fourth of the total harmonics are linearly related with the pitch frequency, while the remaining harmonics in the beginning of the first frame are initialized randomly and later updated continuously over successive frames to maintain harmonic continuity.

The INMARSAT M voice codec phase initialization scheme is computationally intensive. Also, the output speech waveform is biased in an upward or downward direction along the axes. Consequently, chances of speech sample saturation are high, which leads to unwanted distortions in output speech.

An illustrative phase initialization method that incorporates principles of the invention is described below. The illustrative phase initialization method is computationally simple with respect to the algorithm used in INMARSAT M voice codec (Digital voice systems Inc. 1991, version 3.0 August 1991).

In the illustrative phase initialization method, phases for each harmonic are initialized with a fixed set of values for each transition from completely unvoiced frames to voiced frames. These phases are later updated over successive voiced frames to maintain continuity. The initial phases are related to get a balanced output speech waveform. This output speech waveform is balanced on either side of the axis.

The fixed set of phase values eliminate the chance of sample values getting saturated, and thereby remove unwanted distortions in the output speech. One set of phase values, which provide a balanced waveform, is listed below. These are values to which phases of the harmonics get initialized (listed column-wise in increasing order of harmonic number) whenever there is a transition from an unvoiced frame to voiced frame.

Harmonic phase values = {

| | | | |
|---|---|---|---|
| 0.000000, | −2.008388, | −0.368968, | −0.967567, |
| −2.077636, | −1.009797, | −0.129658, | −0.903947, |
| −0.699374, | −1.705878, | 0.425315, | −0.903947, |
| −0.853920, | −0.127823, | −0.897955, | −0.903947, |
| −1.781785, | −2.051089, | 0.511909, | −0.903947, |
| −0.588607, | −1.063303, | −0.957640, | −0.903947, |
| −1.430010, | −0.009230, | −2.185920, | −0.903947, |
| 0.650081, | −0.490472, | −0.631376, | −0.903947, |
| −0.414668, | −2.307083, | −2.315562, | −0.903947, |
| −1.733431, | −0.299851, | −0.901923, | −0.903947, |

-continued

| | | | |
|---|---|---|---|
| 0.060934, | −1.878630, | −2.362951, | −0.903947, |
| −1.085355, | −0.088243, | −0.926879, | −0.903947, |
| −1.994504, | −1.295832, | 0.495461, | |
| } | | | |

The illustrative phase initialization method is computationally simpler with respect to the algorithm of the INMARSAT M voice codec (Digital voice systems Inc. 1991, version 3.0 August 1991). The illustrative method also provides balanced output waveform, which eliminates the chance of unwanted output speech distortions due to saturation. The fixed set of phases also gives the decoded output speech a slightly smoother quality than that of the INMARSAT M voice codec (Digital voice systems Inc. 1991, version 3.0 August 1991), especially in voiced regions of speech.

A different set of phase values that follow the same set pattern could also be used. This is within the scope of this invention.

From the foregoing it will be observed that numerous modifications and variations can be effectuated without departing from the true spirit and scope of the novel concepts of the invention. It is to be understood that no limitation with respect to the exemplary use illustrated is intended or should be inferred. The disclosure is intended to cover by the appended claims all such modifications as fall within the scope of the claims.

What is claimed is:

1. A method for processing a signal, the method comprising the steps of:

dividing the signal into frames, each frame having a corresponding spectrum;

selecting a plurality of pitch candidates from a first frame;

selecting a plurality of pitch candidates from a second frame;

selecting a plurality of pitch candidates from a third frame: calculating a cumulative error function for a plurality of paths, each path including a pitch candidate from the first frame, a pitch candidate from the second frame, and a pitch candidate from the third frame;

selecting a path corresponding to a low cumulative error function;

basing a pitch estimate for a current frame on the selected path;

using the pitch estimate for the current frame to process the signal.

2. The method of claim 1 wherein the first frame is a previous frame and the second frame is a current frame.

3. The method of claim 1 wherein the first frame is a current frame and the second frame is a future frame.

4. The method of claim 1 wherein the first frame is a previous frame, the second frame is a current frame and the third frame is a future frame.

5. The method of claim 1 wherein the plurality of pitch candidates for the first frame is no more than five pitch candidates and the plurality of pitch candidates for the second frame is no more than five pitch candidates.

6. The method of claim 5 wherein a cumulative error function is calculated for all possible paths.

7. The method of claim 1 wherein the selected pitch candidates for the first and second frames have low error functions.

8. The method of claim 7 wherein the error function is a measure of the spectral error between original and synthesized spectra.

9. The method of claim 1 wherein the plurality of pitch candidates for the first frame is no more than five pitch candidates, the plurality of pitch candidates for the second frame is no more than five pitch candidates and the plurality of pitch candidates for the third frame is no more than five pitch candidates.

10. The method of claim 9 wherein a cumulative error function is calculated for all possible paths.

11. The method of claim 1 wherein the selected pitch candidates for the first, second and third frames have low error functions.

12. The method of claim 11 wherein the error function is a measure of the spectral error between original and synthesized spectra.

13. The method of claim 12 wherein a cumulative error function for each path is defined by the equation:

$$CF=k^*(E_{-1}+E_{-2})+\log(P_{-1}/P_{-2})+k^*(E_{-2}+E_{-3})+\log(P_{-2}/P_{-3})$$

wherein $P_{-1}$ is a selected pitch candidate for the first frame, $P_{-2}$ is a selected pitch candidate for the second frame, $P_{-3}$ is a selected pitch estimate for the third frame, $E_{-1}$ is an error for $P_{-1}$, $E_{-2}$ is an error for $P_{-2}$, $E_{-3}$ is an error for $P_{-3}$, and k is a penalising factor.

14. The method of claim 1 wherein the basing a pitch estimate for a current frame on the selected path step further comprises calculating a backward pitch estimate along the selected path, wherein the pitch estimate for a current frame is based on the selected path and the backward pitch estimate.

15. The method of claim 14 wherein the backward pitch estimate is calculated by calculating backward sub-multiples of a pitch candidate for the second frame in the selected path, determining whether the backward submultiples satisfy backward constraint equations, and selecting a low backward sub-multiple as the backward pitch estimate wherein the pitch candidate for the second frame in the selected path is selected as the backward pitch estimate if a backward sub-multiple does not satisfy the backward constraint equations.

16. The method of claim 15 wherein the basing a pitch estimate for a current frame on the selected path step further includes determining a backward cumulative error based on the backward pitch estimate.

17. The method of claim 16, wherein the backward cumulative error is defined by:

$$CE_B(P_B)=E(P_B)+E_{-1}(P_{-1})$$

wherein $E(P_B)$ is an error of the backward pitch estimate and $E_{-1}(P_{-1})$ is an error of the first pitch candidate.

18. The method of claim 1 wherein the basing a pitch estimate for a current frame on the selected path step further comprises calculating a forward pitch estimate along the selected path, wherein the pitch estimate for a current frame is based on the selected path and the forward pitch estimate.

19. The method of claim 18 wherein the basing a pitch estimate for a current frame on the selected path step further comprises calculating a backward pitch estimate along the selected path, wherein the pitch estimate for a current frame is based on the selected path, the forward pitch estimate and the backward pitch estimate.

20. The method of claim 18 wherein the forward pitch estimate is calculated by calculating forward sub-multiples of a pitch candidate for the second frame in the selected path, determining whether the forward sub-multiples satisfy forward constraint equations, and selecting a low forward sub-multiple as the forward pitch estimate wherein the pitch candidate for the second frame in the selected path is selected as the forward pitch estimate if a forward sub-multiple does not satisfy the forward constraint equations.

21. The method of claim 20 wherein the forward constraint equation is selected from the group consisting of:

$$CE_F(P_0/n)\leqq 0.85 \text{ and } (CE_F(P_0/n))/(CE_F(P_0))\leqq 1.7;$$

$$CE_F(P_0/n)\leqq 0.4 \text{ and } (CE_F(P_0/n))/(CE_F(P_0))\leqq 3.5; \text{ and}$$

$$CE_F(P_0/n)\leqq 0.5$$

where $P_0/n$ refers to forward sub-multiples, $P_0$ refers to the pitch candidate for the second frame in the selected path, and $CE_F(P)$ is an error function.

22. The method of claim 20 wherein the basing a pitch estimate for a current frame on the selected path step further includes determining a forward cumulative error based on the forward pitch estimate.

23. The method of claim 22, wherein the forward cumulative error is defined by:

$$CE_F(P_F)=E(P_F)+E_{-1}(P_{-1})$$

wherein $E(P_F)$ is an error for the forward pitch estimate and $E_{-1}(P_{-1})$ is an error of the first pitch candidate.

24. The method of claim 23 wherein the basing a pitch estimate for a current frame on the selected path step further comprises calculating a backward pitch estimate along the selected path, wherein the backward pitch estimate is used to calculate a backward cumulative error, the pitch estimate being based on the selected path, the forward cumulative error and the backward cumulative error.

25. The method of claim 24, wherein the basing a pitch estimate for a current frame on the selected path step further comprises comparing the forward and backward cumulative errors with one another, selecting the pitch estimate as the forward pitch estimate if the forward cumulative error is less than the backward cumulative error, and selecting the pitch estimate as the backward pitch estimate if the backward cumulative error is less than the forward cumulative error.

26. A method for processing a signal comprising the steps of:

dividing the signal into frames;

obtaining a pitch estimate for a current frame;

refining the obtained pitch estimate comprising the sub-step of:

computing backward and forward sub-multiples of the obtained pitch estimate for the current frame;

determining whether the backward sub-multiples satisfy at least one backward constraint equation;

determining whether the forward sub-multiples satisfy at least one forward constraint equation;

selecting a low backward sub-multiple that satisfies the at least one backward constraint equation as the backward pitch estimate, wherein the obtained pitch estimate of the current frame is selected as the backward pitch estimate if a backward sub-multiple does not satisfy the at least one backward constraint equation;

selecting a low forward sub-multiple that satisfies the at least one forward constraint equation as the forward pitch estimate, wherein the obtained pitch estimate of the current frame is selected as the forward pitch estimate if a forward sub-multiple does not satisfy the at least one forward constraint equation;

using the backward pitch estimate to compute a backward cumulative error;

using the forward pitch estimate to compute a forward cumulative error;

comparing the forward cumulative error to the backward cumulative error;

refining the chosen pitch estimate for the current frame based on the comparison; and using the refined pitch estimate for the current frame to process the signal.

* * * * *

UNITED STATES PATENT AND TRADEMARK OFFICE

CERTIFICATE OF CORRECTION

PATENT NO. : 6,963,833 B1
APPLICATION NO. : 09/697276
DATED : November 8, 2005
INVENTOR(S) : Manoj Kumar Singhal, Sangeetha and Puranjoy Bhattacharya It is certified that error appears in the above-identified patent and that said Letters Patent is hereby corrected as shown below:

Title page, item [75]
Inventors,
Change "Manoj Kumar Singhal, Bangalore (IN)" to -- Manoj Kumar Singhal, Bangalore (IN); Sangeetha, Bangalore (IN); Puranjoy Bhattacharya, Bangalore (IN) --.

Signed and Sealed this

Fourteenth Day of July, 2009

JOHN DOLL
*Acting Director of the United States Patent and Trademark Office*